United States Patent [19]

Paley

[11] Patent Number: 4,640,019

[45] Date of Patent: Feb. 3, 1987

[54] TEMPLATE FOR INSTALLATION OF ELECTRIC DOOR STRIKES

[75] Inventor: Gary Paley, Cornwall-on-Hudson, N.Y.

[73] Assignee: Trine Products Corporation, Bronx, N.Y.

[21] Appl. No.: 856,851

[22] Filed: Apr. 21, 1986

Related U.S. Application Data

[63] Continuation of Ser. No. 652,385, Sep. 20, 1984, abandoned.

[51] Int. Cl.[4] ..... E05B 17/06

[52] U.S. Cl. ..... 33/563; 33/197

[58] Field of Search ..... 33/197, 562–566, 33/11, 12, 297, 189, 191, 1 C, 1 G, 1 N, 23 K, 190, 486, 528, 184.5, DIG. 16; D10/65

[56] References Cited

U.S. PATENT DOCUMENTS

| | | | |
|---|---|---|---|
| D. 140,152 | 1/1945 | Aichele | D10/65 |
| 292,463 | 1/1884 | Bassett | 33/197 |
| 648,471 | 5/1900 | Voight | 33/197 |
| 664,910 | 1/1901 | Voight | 33/197 |
| 1,665,842 | 4/1928 | Brunings | 33/184.5 |
| 2,810,205 | 10/1957 | Beck | 33/563 |
| 2,862,302 | 12/1958 | Lucia | 33/197 |

*Primary Examiner*—Charles Frankfort
*Assistant Examiner*—Patrick R. Scanlon
*Attorney, Agent, or Firm*—Brooks Haidt Haffner & Delahunty

[57] ABSTRACT

This disclosure depicts a novel method and apparatus for determining the amount of material to be removed in a door jamb for the installation of an electric door strike. In particular, the apparatus comprises a template comprised of an elongate paperlike sheet in the shape or outline of the front view of the electric door strike to be installed in the door jam, the template having an open area therein through which measurement markings made on the door jam are aligned through the template, the template also having an adhesive material on the back thereof for securing the template firmly to the door jamb while the outline of the door strike is traced onto the jamb. The method described herein is for the purpose of practicing the above-mentioned determination of material to be removed from the door jamb.

5 Claims, 5 Drawing Figures

TEMPLATE FOR INSTALLATION OF ELECTRIC DOOR STRIKES

This application is a continuation of application Ser. No. 652,385, filed on Sept. 20, 1984 now abandoned.

BACKGROUND OF THE INVENTION

This invention relates generally to electric door strikes and the means and method of installing same in a wooden or metal door jamb. In particular, the present invention relates to a template designed to be placed over the door jamb which provides an outline of the electric door strike to be inserted therein.

Many manufacturers of electric door strikes intend for the door strike to be assembled into a metal or wooden door frame at either the construction site, upon the initial construction of a residence or commercial establishment, or as a replacement in an existing structure for a standard door bolt and latch. Both metal and wooden door jambs pose a problem for the installation of electric strikes in that they are not generally precut to receive the elongated door strike and do not have a side portion of the door jamb removed to allow for the insertion of the electric strike. Thus, when installing an electric door strike into a traditional metal or wooden jamb, the installer must make various cuts to either mortis the wooden jamb such that it will receive the electric strike, or to cut out metal from the metal jamb for the installation of the electric strike. It is critical to properly align the mortis in the wooden jamb or the cut out portions of the metal jamb so that the installed electric door strike will mate with the latch bolt on the door. Improper alignment of the electric door strike will result in failure of the electric strike to operate properly, or failure of the door to close and lock. Thus, it is crucial to properly cut the metal out of the door jamb or, in a wooden door jamb, to properly mortise the jamb to receive the electric strike.

In the past, this alignment has been accomplished by either measuring the location of the electric strike on the jamb and attempting to cut out the appropriate portion on the metal jamb or to mortise the appropriate portions of the wooden jamb by eye. This procedure allows great room for human error and improper alignment of the electric strike in the jamb. Some manufacturers of electric door strikes have in the past provided an outline of the electric strike on a paper or cardboard template. The template is intended to be placed over the jamb and the outline may then be traced onto the jamb for indicating the areas to be removed. No method for properly aligning this template or for retaining the template to the jamb had been provided. Thus, the installer had to "eyeball" or measure to general dimensions the location on the jamb for the template to be placed. Again, this provided room for human error and for misalignment of the electric door strike in the jamb.

Thus, there exists a need in the field for a means to install an electric door strike into a metal or wooden door jamb where said means will allow for the proper alignment of the electric strike in the jamb and will greatly reduce the possibility of human error in the installation process.

SUMMARY OF THE INVENTION

It is a general object of the present invention to provide a template for installation of an electric door strike where said template contains a means for locating the template on a jamb thereby aligning the template over the proper position on the jamb for the installation of the door strike. It is a more specific object of the present invention to provide a template for installation of electric door strikes where said template has means for retaining the template in a single position on the door jamb and which indicates the outline of the electric door strike and thus the necessary material to remove from the jamb.

The above objects are accomplished by providing a template in the outline of a front view of the electric door strike to be installed. The template having thereon a vertical scored area and a horizontal scored area, the scored areas forming a "crosshair" type opening in the template. The crosshairs are located on the template such that when the scored areas are removed and the "crosshair" portion formed thereby is properly aligned on the door jamb over vertical and horizontal measurements made by the installer, the template is oriented with respect to the jamb such that the outline of the door strike may readily be inscribed on the jamb. To properly align the template on the jamb, it is necessary to make only two measurements. The first is the measurement from the floor to the latch cavity, usually 37" above the fininshed floor line. Once this measurement is made, a horizontal mark is placed on the door jamb. For the second measurement, the distance from the edge of the door to the back of the latch bolt is measured. This measurement is transferred to the door jamb which forms the location on the jamb for the marking of a vertical line on the door jamb. The horizontal and vertical lines combine to form a crosshair on the jamb with which the scored area crosshairs are aligned over on the template.

The template contains an adhesive material on the back thereof. The adhesive material can be exposed by peeling off a separate strip on the back of the template, thus preparing the template for adhering it to the door jamb. By aligning the scored areas on the template with the crosshair measurements made on the door jamb and adhering the template to the jamb in this position, the template is properly aligned on the door jamb and illustrates the outline of the door strike to be installed therein.

The installer then traces the outline onto the jamb, removes the template, and makes the necessary cuts into the metal, or makes the necessary mortises into the wooden door jamb to provide the room for the installation of the electric door strike. The above template insures that the proper amount of material will be cut from a metal door jamb and that once the electric strike is installed there will be no misalignment. Further, the template increases the efficiency of an installer as it allows the installer to more quickly and efficiently locate the exact area on the door jamb that must be mortised or removed.

Further objects and advantages of the invention will in part become apparent as the following description proceeds. The features of novelty which characterize the invention will be pointed out with particularity in the claims annexed to and forming a part of this specification.

DESCRIPTION OF THE DRAWINGS

The invention together with further objects and advantages may best be understood by reference to the following description taken in conjunction with the accompanying drawings, in several figures of which like reference numberals identify like elements, and in which.

DETAILED DESCRIPTION

Figure 1:
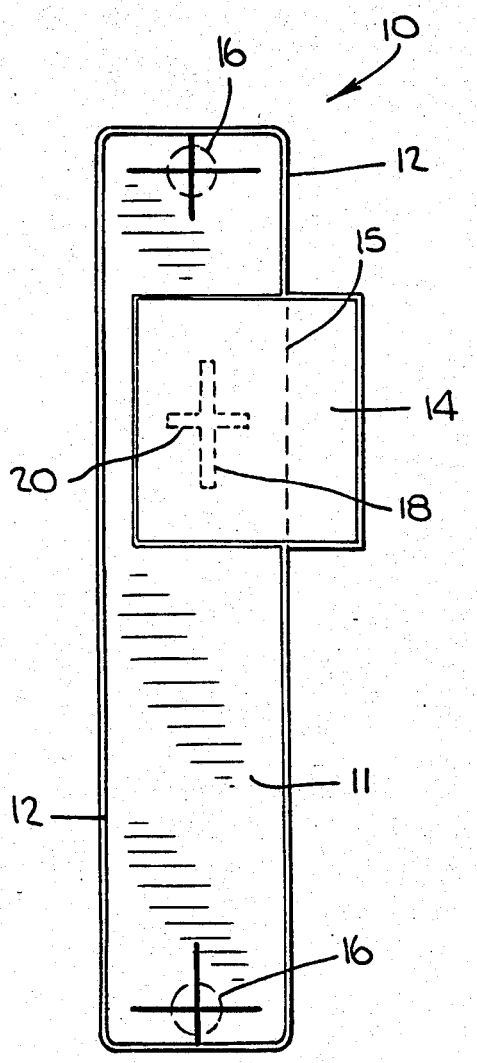
FIG. 1 is a front elevation view of the template for installation of electric door strikes.

Referring now to FIG. 1 of the drawings, the template 10 is shown in front view having front side 11. Template 10 is formed in the outline 12 of an electric door strike including the jamb cut out 14 shown extending from the side of template 10. Jamb cutout 14 has fold line 15. Scorelines 16 are provided for allowing a circular section of the template 10 to be removed for indicating the exact location that the mounting screws of the electric door strike should be drilled into the jamb. Template 10 has vertical crosshair scored area 18 inscribed on the face thereof and has horizontal crosshair scored area 20 thereon. Scored areas 18 and 20 intersect to form an open area, discussed below, when the scored areas of the template 10 are removed.

Template 10 is intended to be manufactured of a flexible material such as cardboard or paper such that the scorelines allow the scored areas 16, 18 and 20 to be easily removed from the template 10 and which will allow jamb cut out 14 to be easily folded along fold line 15. Vertical scored area 18 allows a vertical elongated section of the template to be removed. Horizontal scored area 20 is shown intersecting at a right angle to vertical scored area 18. Like vertical scored area 18, horizontal scored area 20 allows an elongated portion of the template to be removed.

It should be noted that template 10 has two scored areas 16 to provide for the pair of mounting screws normally used to mount the door jamb strike plate or the electric strike to the jamb. If the holes provided by the door jamb strike plate are not already aligned with scored areas 16, the removal of the scored areas 16 will show the proper location for the drilling of the screw holes for the installation of the electric strike when the template 10 is placed over the jamb as discussed below.

Figure 2:
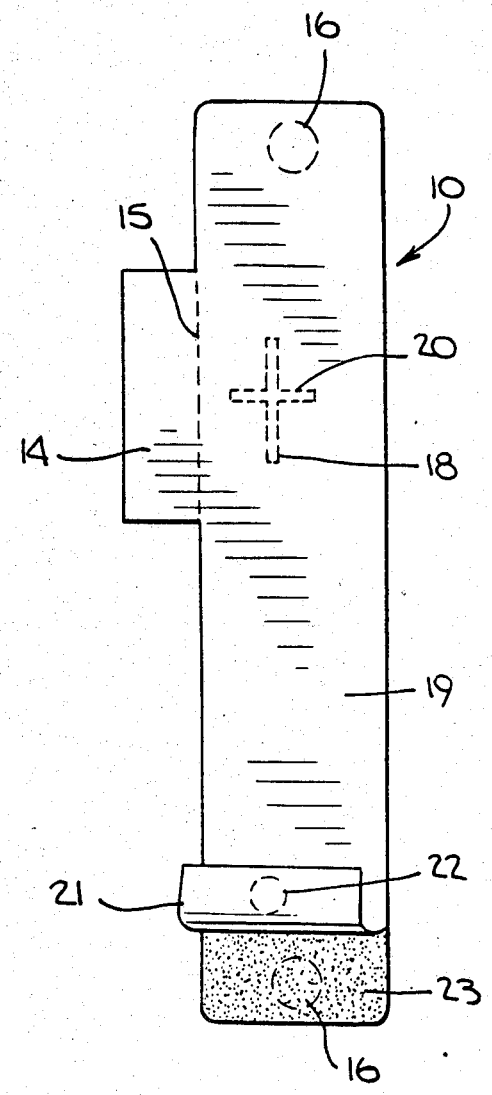
FIG. 2 is a rear view of the template.

FIG. 2 illustrates the rear view of template 10. Note the removeable paper backing 21 shown partially peeled off of the back 19 of template 10. Adhesive material 23 is shown placed between paper backing 21 and back 19 of template 10. A material such as that produced by MacTac, its Starliner TM brand of peel away adhesive backing, may be used for this application. However, any suitable adhesive material may be used. The purpose of the adhesive backing is to provide a means by which the template 10 is securable to the jamb.

Figure 5:
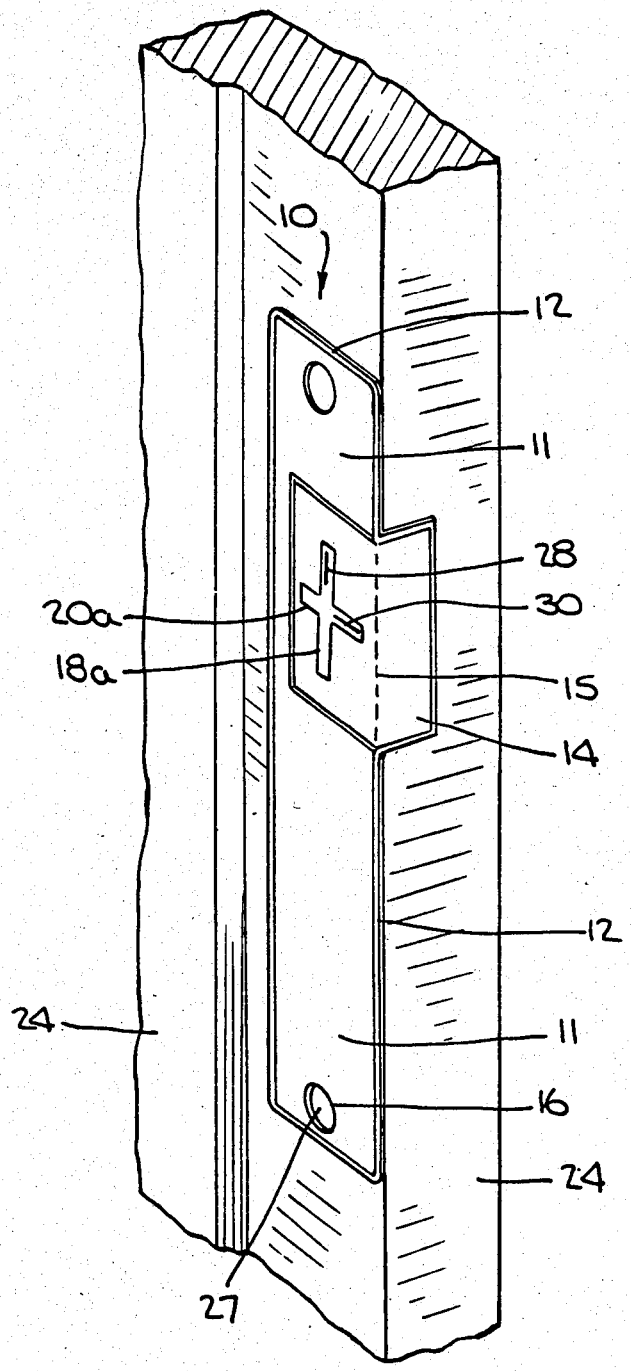
FIG. 5 is a front perspective view of the template applied to the door jamb showing the side jamb cutout folded around the jamb and the measurement crosshairs located within the removed scored areas of the template.

The paper backing 21 is removed as shown in FIG. 2 to expose the adhesive material 23. The back side 19 of template 10 is then applied to the door jamb in the desired position to secure the template 10 to the door jamb at the proper location. This is shown in FIG. 5. FIG. 5 illustrates the template 10 secured to door jamb 24 in the proper position. It should be noted that scored areas 16 project through both the back side 19 of template 10 and the paper backing 21 which is adhered to the back side of template 10. This paper backing 21 prevents the template 10 from sticking to other objects prior to its intended use. It should be noted that any suitable adhesive material may be used to secure the template to the proper position on the door jamb. It is anticipated that the paper backing material will cover the entire back side 19 of template 10 including the jamb cut out section 14 shown both in FIGS. 1 and 2 as extending laterally from the side of template 10. The adhesive material 23 is also anticipated to cover the entire backside 19 of the template 10. The invention may also be practiced by using spot locations of adhesive on the backside 19 rather than over the entire area, to reduce the amount of adhesive 23 and backing 21 needed. FIG. 2 also shows in dotted line the fold line 15 which is intended to provide the visualization of the line upon which jamb cut out section 14 is to be folded against the door jamb. Removal of material from the door jamb in this area allows the strike to operate freely.

Figure 3:
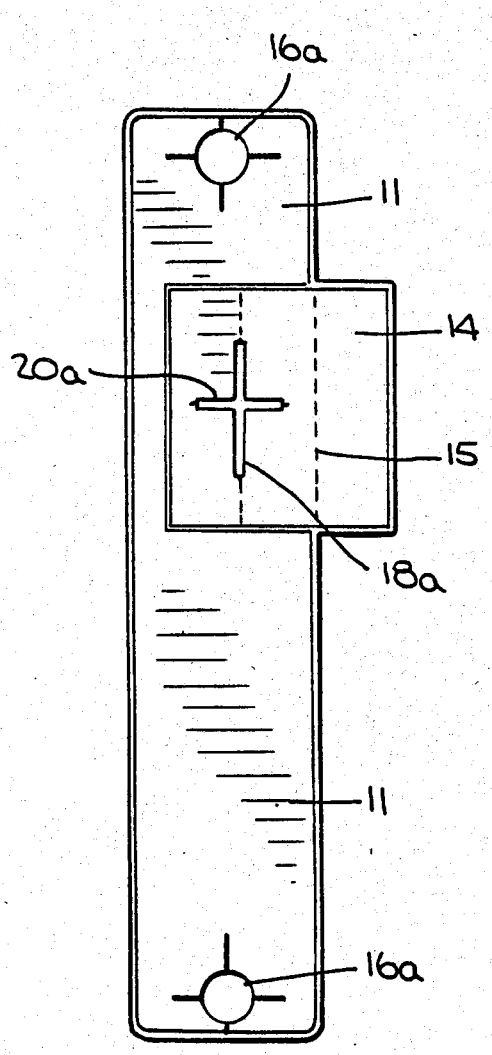
FIG. 3 is a front view of the template with the scored areas removed.

FIG. 3 illustrates the front side 11 of template 10 with scored areas 18 and 20 removed, exposing openings **18*a* and 20*a*. Openings 18*a* and 20*a* form an area in the shape of a cross and extend through the width of template 10. Scored areas 16 are also shown as removed in FIG. 3 exposing openings 16*a*** to mark the area for the drilling of the mounting screws.

Figure 4:
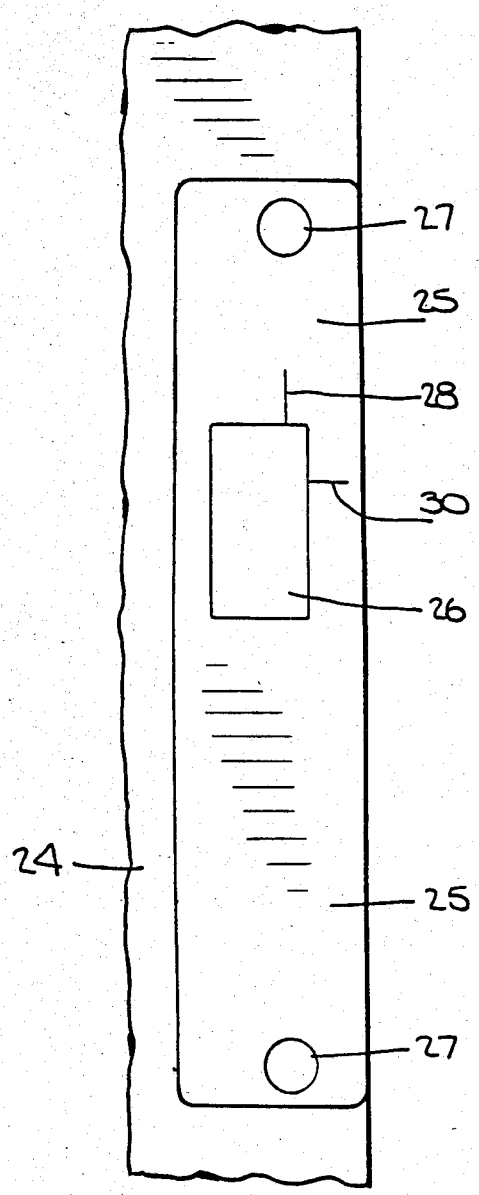
FIG. 4 is a front plan view of a door jamb with the measurement crosshairs shown thereon.

FIG. 4 illustrates the door jamb 24 having strike plate 25 mounted thereon with door latch receiving area 26 therein. Crosshairs 28 and 30 have been inscribed on the jamb 24. Crosshair 30 represents the distance from the floor to the centerpoint of the latch receiving area in which the electric strike is to be mounted. This distance is normally $37\frac{1}{2}$ inches from the floor. Crosshair 28 represents the distance from the edge of the door to the edge of the door latch. While a rather elongated strike plate 25 is shown in FIG. 4, it should be noted that the size of particular strike plates may vary and may be of differing lengths. Thus, the areas **16*a* of FIG. 3 may not always line up with the mounting screw receiving areas 27 shown in FIG. 4. When that happens, new mounting screw receiving areas must be drilled to accommodate the mounting screws for the electric strike, in accordance with the positioning of areas 16*a* over the jamb 24**.

In FIG. 5 template 10 is shown adhered over door jamb 24 with horizontal scored area 20 and vertical scored area 18 removed thereby creating openings **18*a* and 20*a*. Jam cutout 14 is shown folded along fold line 15 over the portion of door jamb 24 which is to be removed from the door jamb 24 to allow for the installation of the electric door strike. Template 10 shows in FIG. 5 the outline 12 of the electric door strike on the door jamb 24. This outline 12 can now be traced by the installer onto the door jamb. The template 10 is adhered to the door jamb temporarily by virtue of the adhesive material 23 on the rear side 19 of the template 10. Of course, the template 10 is not adhered to the door jamb until crosshairs 28 and 30 are aligned within the open score areas 18*a* and 20*a*. Once the template 10 is placed over door jamb 24, markings are made on the door jamb for screw holes 27, for proper drilling of the holes in the jamb to mount the electric strike. Once these holes are marked and the outline is traced onto the door jamb 24, the template is removed. The installer then may make the appropriate cuts or mortises into the door jamb based on the outlined drawing around the template onto jamb 24. The cuts or mortises, if made in accordance with the outline, will insure that only the required amount of material necessary to install the electric door strike is removed from the jamb. Since the measurements were made in accordance with the location of the door latch and the center location of the door latch receiving area, the electric door strike will be properly mounted so long as the crosshairs 28 and 30 from these measurements were aligned within the scored areas 18***a* and 20*a* of the template. Once the appropriate amount of material according to the outline traced from the template 10 has been removed from door jamb 24, the electric door strike may then be installed.

The above represents a simple and efficient means for preparing a door jamb to receive an electric door strike. It can be used on door jambs in existing structures desired to be modified to accept an electric strike or on the original installation of the door jamb in new or remodeled structures. Proper use of the scored areas 18*a* and 20*a* with crosshairs 28 and 30 will insure that the door strike outline is accurately traced onto the door jamb 24. This reduces the element of human error involved in the installation of the door strike and increases the likelihood that the strike will be correctly installed and operate properly with a minimum of labor on the part of the installer.

The invention is not limited to the particular details of construction depicted and other modifications and applications are contemplated. For example, the shape of the template can be changed to conform to different sized door strikes or different sized objects of other characters which may be desired to be added to a door jamb or a door. Further, the crosshair score lines 18 and 20 need not be at right angle lines. Other means for aligning the template onto the door jamb could be used such as a circular shape, or a square shaped cutout. It is believed, however, that the crosshair approach is the best mode for practicing the instant invention. Certain other changes may be made in the above described invention without departing from the true spirit and scope herein. It is intended therefore, that the subject matter in the above depiction shall be interpreted as an illustrative and not in a limiting sense.

I claim:

1. A template for outlining an area on a door jamb which is to be removed to facilitate the installation of an electric door strike into the door jamb, said template comprising a flexible, paperlike sheet in the shape of a front view of an electric door strike, said template further having a section for outlining, on the side of the jamb, a portion within said area to be removed which is cut deeper to accomodate installation of the electric door strike, said section protruding from the side of the template and having a fold line scored therein to facilitate the folding of the section over the jamb; a first open area in the form of a cross, disposed along the interior of said sheet, said first open area allowing a portion of the jamb to be viewed therethrough when said template is placed over the jamb, means for retaining the template to the jamb comprising an adhesive applied to the back of the template such that the adhesive will temporarily maintain the template on the jamb, such that when a select portion of the jamb has a pair of locating marks placed on the jamb at select locations the placement of the first open area over the marks aligns the template over the portion of the jamb to be removed, and second and third open areas spaced from the first open area for indicating the location for drilling screw holes in said jamb such that placing the template over the jamb indicates the portion of the jamb to be removed for installation of the electric door strike.

2. The template of claim 1 where the adhesive has a removeable paper backing applied thereover to prevent the template from sticking to objects when not in use.

3. A template for outlining the area to be removed from a door jamb for the installation of an electric strike into said jamb, said template comprising a flexible paperlike sheet having an outline in the shape of a front view of the electric door strike to be installed in a door jamb, said template further having a section for outlining, on the side of the jamb, a portion within said area to be removed which is cut deeper to accomodate installation of the electric door strike, said section protruding from the side of the template and having a fold line scored therein to facilitate the folding of the section over the jamb; a first open area in the shape of a cross therethrough for aligning the template on the door jamb, means for temporarily maintaining the template on the door jamb, means for locating the position of mounting screw holes in the door jamb for installing the electric strike into the jamb, such that when a pair of markings are placed at select locations on the jamb the placement of the first open area over the markings aligns the template over the jamb thereby identifying the portion of the jamb to be removed.

4. The template of claim 3 where said screw hole locating means comprises second and third open areas through said template, said second and third open areas disposed on said template such that when said template is aligned on a door jamb said second and third open areas overlie and identify the positions on the jamb for drilling the screw mounting holes for installation of the electric door strike.

5. A method for determining the amount of material to be removed from a door jamb in a doorway having a door pivotally mounted therein said door having a latch and said jamb having a latch cavity, for the installation of an electric door strike, including the steps of:

measuring the height from the floor to the center of the latch cavity and marking the height on the door jamb;

measuring the distance from an edge of the door latch to an edge of a latch side of the door and marking this measurement on the door jamb adjacent the first said marking such that the markings are at right angles to one another;

aligning a crossed open area in a template having a shape substantially corresponding to the front view of an electric door strike with the markings made on the door jamb;

temporarily adhering the aligned template to the door jamb such that said markings are visible through said crossed open area; folding a section of the template that protrudes from the template about a fold line scored therein over the side of the jamb to provide an indication of the depth of the amount of material to be removed, tracing the outline of the template, including the folded section onto the door jamb, removing the template from the jamb such that the portion of the door jamb within the outlined area may be mortised for the installation of an electric door strike.

* * * * *